United States Patent [19]

Mathewson

[11] 3,994,253

[45] Nov. 30, 1976

[54] FLAP ACTUATOR CONTROL UNIT FOR A HYDROFOIL

[75] Inventor: Edward Lee Mathewson, Bellevue, Wash.

[73] Assignee: The Boeing Company, Seattle, Wash.

[22] Filed: June 11, 1975

[21] Appl. No.: 586,119

[52] U.S. Cl. ..... 114/66.5 H

[51] Int. Cl.[2] ..... B63B 1/18; B63B 1/24

[58] Field of Search ..... 114/16 R, 16 E, 16 F, 114/66.5 H

[56] References Cited

UNITED STATES PATENTS

| | | | |
|---|---|---|---|
| 3,125,975 | 3/1964 | Alsager et al. | 114/16 R |
| 3,139,059 | 6/1964 | Hanford, Jr. | 114/66.5 H |
| 3,146,457 | 8/1964 | Von Schertel | 114/66.5 H |
| 3,364,892 | 1/1968 | Persson et al. | 114/66.5 H |
| 3,756,180 | 9/1973 | Strickland et al. | 114/16 R |

*Primary Examiner*—Stephen G. Kunin
*Attorney, Agent, or Firm*—Mark J. Zovko, Jr.

[57] ABSTRACT

A novel flap actuator control unit for a hydrofoil craft. The control unit includes an actuator disposed in a submerged housing located in proximity to the hydrofoil control flaps, thus eliminating long, precise, and costly linkages needed on conventional flap actuator control units. To prevent sea water leakage into the actuator housing, the housing is filled with an inert fluid, such as oil, from a surge tank disposed above the waterline. When the hydrofoil is underway, the fluid is compressed or expanded by a free floating piston which responds to the external dynamic pressure thereby a balance between internal and external pressure is maintained and leakage into the actuator housing avoided.

5 Claims, 5 Drawing Figures

FLAP ACTUATOR CONTROL UNIT FOR A HYDROFOIL

BAKCGROUND OF THE INVENTION

This disclosure relates in general to flap actuator control units for hydrofoil craft and more particularly to a novel flap actuator control unit having a submerged flap actuator protected from sea water during operation of the hydrofoil craft.

In a conventional hydrofoil craft, submerged water foils supports the hull which remains out of the water during operation. The hydrofoil hull is maintained at a substantially constant level out of the water by a plurality of flaps on the aft end of the foil which may be raised up or down. These flaps also control turning, and generally affect the craft's overall maneuverability. The signal to the flaps is usually generated by an automatic control unit located on board the craft. An actuator of some type such as an electric or hydraulic servo-mechanism translates the control signals to an actual change in flap angle. Usually the flap servoactuators are located at a remote point from the flap within the hull of the craft. The actuators are not proximate to the flaps because of the sea water environment around the flaps, and also because of the accessibility associated with locating an actuator within the craft's hull. Even intermittent exposure of the actuator to sea water has a detrimental effect. Failure of the hydrofoil automatic control system can be the result of even slight exposure of the actuator to brine. Furthermore, actuators tend to corrode after exposure to sea water. The critical surface finish of actuator piston rods exposed to stagnant sea water pit badly causing premature acutator rod seal failure, and ultimately contamination of the entire hydraulic flap actuator system.

In relatively small hydrofoil craft control flap actuation is conventionally provided by a power source through mechanical linkage from remotely located hydraulic actuators mounted above the hullborne waterline of the associated struts. As the size of the hydrofoil increases, the problem inherent in the mechanical linkages becomes more difficult to overcome. Greater strut lengths, foil spans, flap chords, and mechanical components size, as well as large structural deflections throughout the system contribute to the difficulties.

The remote flap actuator unit is especially applicable to an "external flap arrangement" wherein the hydrofoil control flap is located slightly below the trailing edge of the main foil. An external flap arrangement is desirable for large hydrofoil craft. In this type of arrangement, usually a pair of servoactuators mounted above the hullborne waterline are employed. Push-rods inside the struts of the hydrofoil pass through a series of guide bearings and connect the servoactuators to crank arms within the hydrofoil pods. The crank arms are connected to torque tubes located within the foils. The torque tubes distribute torque to individual crank arm mechanisms which in turn rotate the flap. The flap control unit has two primary advantages: (1)high servoactuator reliability because of the absence of a sea water environment and (2) easy access to the servoactuator for maintenance, inspection or replacement.

Significant disadvantages, however, to the remote actuator flap control unit are present. These disadvantages include the following: heavy, long, stiff linkages are required: costly precision parts are required due to close tolerances; the propulsion machinery arrangement or water jet ducts in the pod unduly constrain the space required for the crank arm linkage envelopes; two translating and four rotating mechanism seals are needed to maintain water tight integrity of the pod, all of which are potential failure parts; and the parts of the overall unit except for the servoactuators are unaccessible.

SUMMARY OF THE INVENTION

In my invention, a hydrofoil flap actuator control unit is disclosed which comprises in combination a housing mounted to the strutfoil assembly of the hydrofoil craft, an actuator connected to the control flaps and mounted within the housing for operating the control flaps; an inert fluid filling the housing; and an internal pressure regulating means external to the housing yet in communication with it. The internal pressure regulating means is responsive to the external dynamic pressure upon the housing caused by the craft's movement through water and so constructed that the internal pressure on the inert fluid in the housing counterbalances the external dynamic pressure on the housing. In the preferred embodiment of my invention, the means used to regulate internal pressure is comprised of a tank containing inert fluid and mounted on the hydrofoil craft with at least a portion of the tank above the hullborne waterline; a first conduit connecting the tank with an elongated chamber disposed in the strut-foil assembly of the hydrofoil; a second conduit connected the aft end of the elongated chamber to the housing; a check valve disposed in the first conduit which permits flow from the tank to the elongated chamber only; and a piston disposed in the elongated chamber. The fore surface of the piston is open to the external environment through an aperture in fore end of the chamber. The external dynamic pressure on the fore surface of the piston is thereby counterblanced by the inert fluid in the tank, the conduits, and the housing. The internal pressure in the actuator housing of my invention remains substantially equal to the external pressure on the housing, and sea water leakage into the actuator housing is eliminated.

It is the object of my invention therefore, to provide a flap actuator unit for a hydrofoil craft which has adequate sea water leakage protection for the control flap actuator under relatively high dynamic pressure during operation of the craft.

Another object of my invention is to provide a flap actuator unit for a hydrofoil craft which allows access to the actuator for maintenance, inspection or replacement without requiring dry docking of the craft.

A further object of my invention is to provide a simple yet reliable flap actuator unit for a hydrofoil craft.

Yet another object of my invention is to provide a flap actuator control unit for a hydrofoil craft which does not require heavy, long linkages to effect control flap movement.

Still another object of my invention is to provide a flap actuator control unit for a hydrofoil craft which does not require precision components.

Another object of my invention is to provide a flap actuator control unit for a hydrofoil craft with low material, installation and maintenance costs.

Still another object of my invention is to provide a flap actuator control unit which does not require a plurality of translating or rotating mechanism seals in the main pods located at the strut foil intersections. These and other objects or advantages of my invention will become apparent from the following detailed description when taken in conjunction with the drawings in which.

Figure 1:
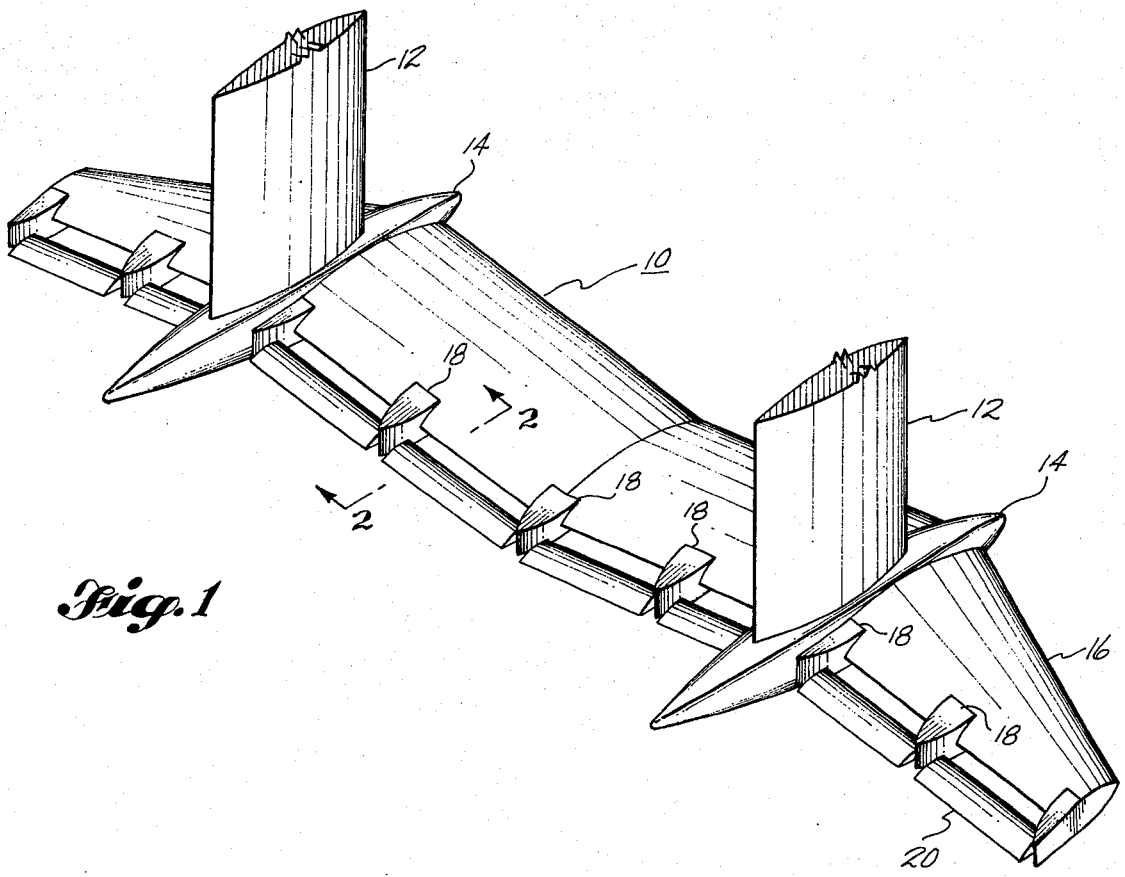
FIG. 1 is an isometic view of the strut-foil assembly of a hyrofoil craft utilizing the flap actuator control unit of my invention.
Figure 2:
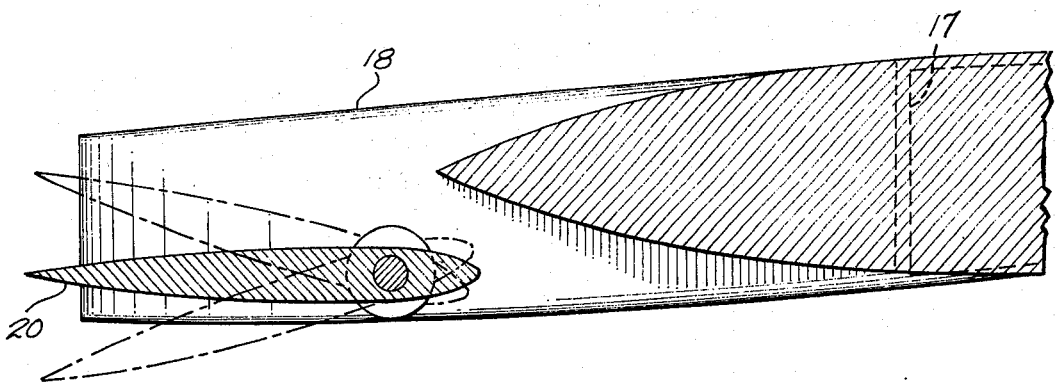
FIG. 2 is a sectional view taken through line 2—2 of FIG. 1 showing the flap, the actuator housing, and the foil.
Figure 4:
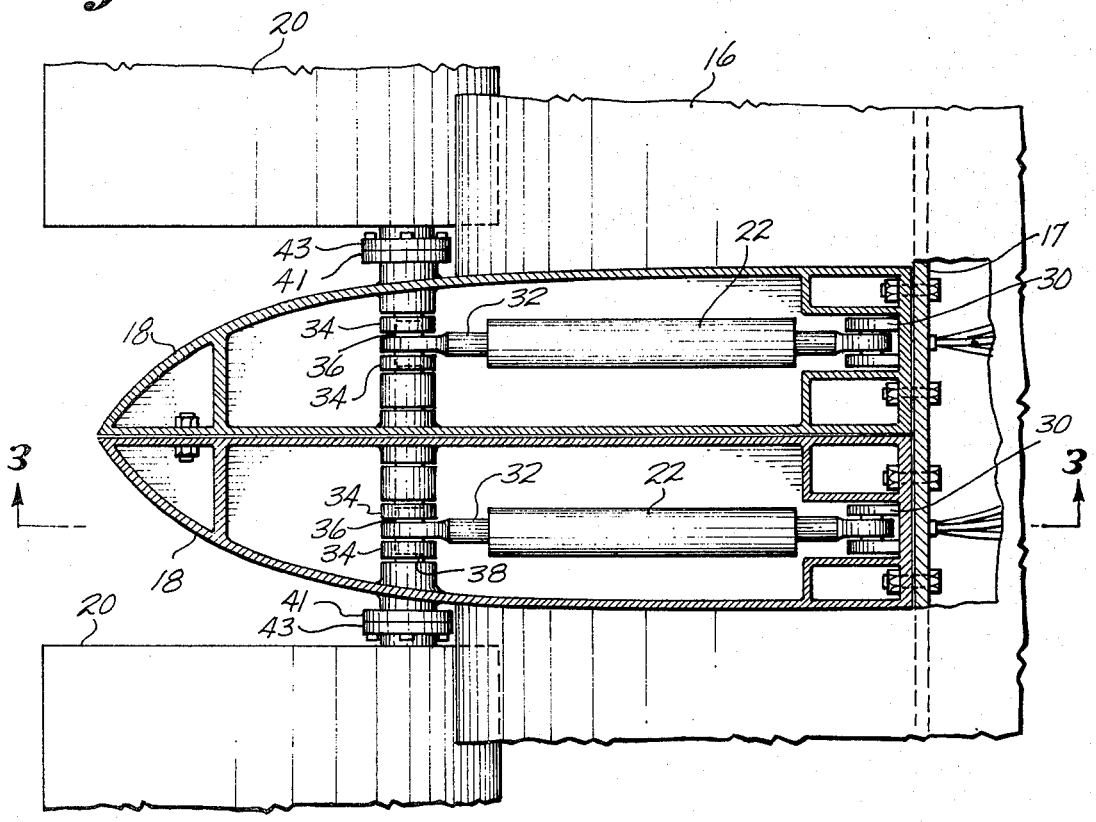
FIG. 4 is a sectional plan view of the housing for the flap actuator taken through line 4—4 of FIG. 3.

Referring to FIG. 1 and 2, reference numeral 10 generally designates the lower portion of an aft strut-foil assembly for a hydrofoil craft. Although my invention will be described using an aft foil assembly, it is also directly applicable to a forward foil assembly. The strut-foil assembly 10 has struts 12 which lead downward from the hull of the hydrofoil craft (not shown) to machinery pods 14. The machinery pods 14 contain propulsion power train components (not shown) which serve to propell the ship when foilborne. The foil 16 is attached to the pods 14 and is designed to supply lift to the hydrofoil craft during foilborne operation. The unserside of the foil 16 is structurally bolstered by a spar 17 (FIG. 4). A plurality of flap actuator housings 18 are fastened to spar 17. Between the flap actuator housings 18 and connected thereto are a plurality of control flaps 20 which are actuated whenever a change in the craft's height, or roll or pitch attitude is desired.

Figure 3:
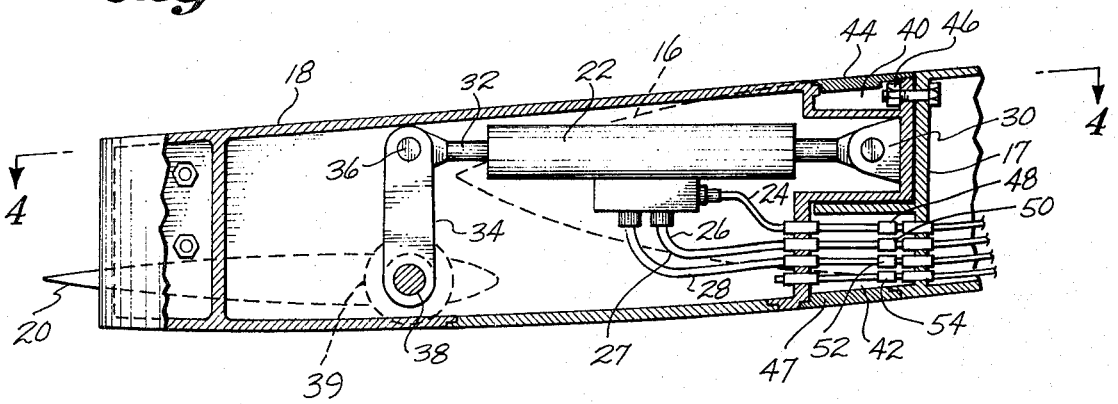
FIG. 3 is a sectional view of the housing for the flap actuator.

Referring now to FIGS. 3 and 4, the internal structure of a representative flap actuator housing 18 is shown. Located within the housing 18 are a pair of mating half-housings containing servoactuators 22. As shown in FIG. 4, the housing 18 is symetrical and my invention will be described for one half of the actual housing 18. Three connector lines designated 24, 26, 28 are connected directly to the actuator 22. Electrical connector line 24 is used as a conduit for electrical connection, while connector lines 26 and 28 are the supply and return lines respectively for a hydraulic fluid (not shown), which operates the actuator 22. The internal structure of the actuator is not shown and can be of any conventional design consistent with the power requirements associated with moving control flaps 20. For example, actuating means consisting of an electric motor driven hydraulic servopump and self contained hydraulic loop could be used. The actuator 22 is mounted within the housing by suitable mounting means 30. A rod 32 extends rearwardly from the body of servoactuator 22 and is attached to a rotation link 34 by means of shaft 36. Rotation link 34 is then connected via shaft 38 through rotatable water tight seal 39 to the attachment flange 41. Flange 41 mates with and is securely attached to flap flange 43 of control flap 20 by bolting. A movement in rod 32, therefore, will be translated through rotation link 34 to a raising or lowering of the leading edge of control flap 20.

Actuator housing 18 includes two compartments designated as 40 and 42. Located on the top side of housing 18 and having an access cover 44, compartment 40 contains mounting means 46 for mounting the housing 18 to the foil spar 17. Compartment 42 is located on the underside of housing 18 and has an access cover 47. Within compartment 42, a series of self sealing "quick disconnect" fittings designated as 48, 50, 52 and 54 for the connector lines 24, 26, 28 and 56 respectively. A fluid line 56 leading into the housing 18 serves as an entry or exit point for fluid housing 18.

Figure 5:
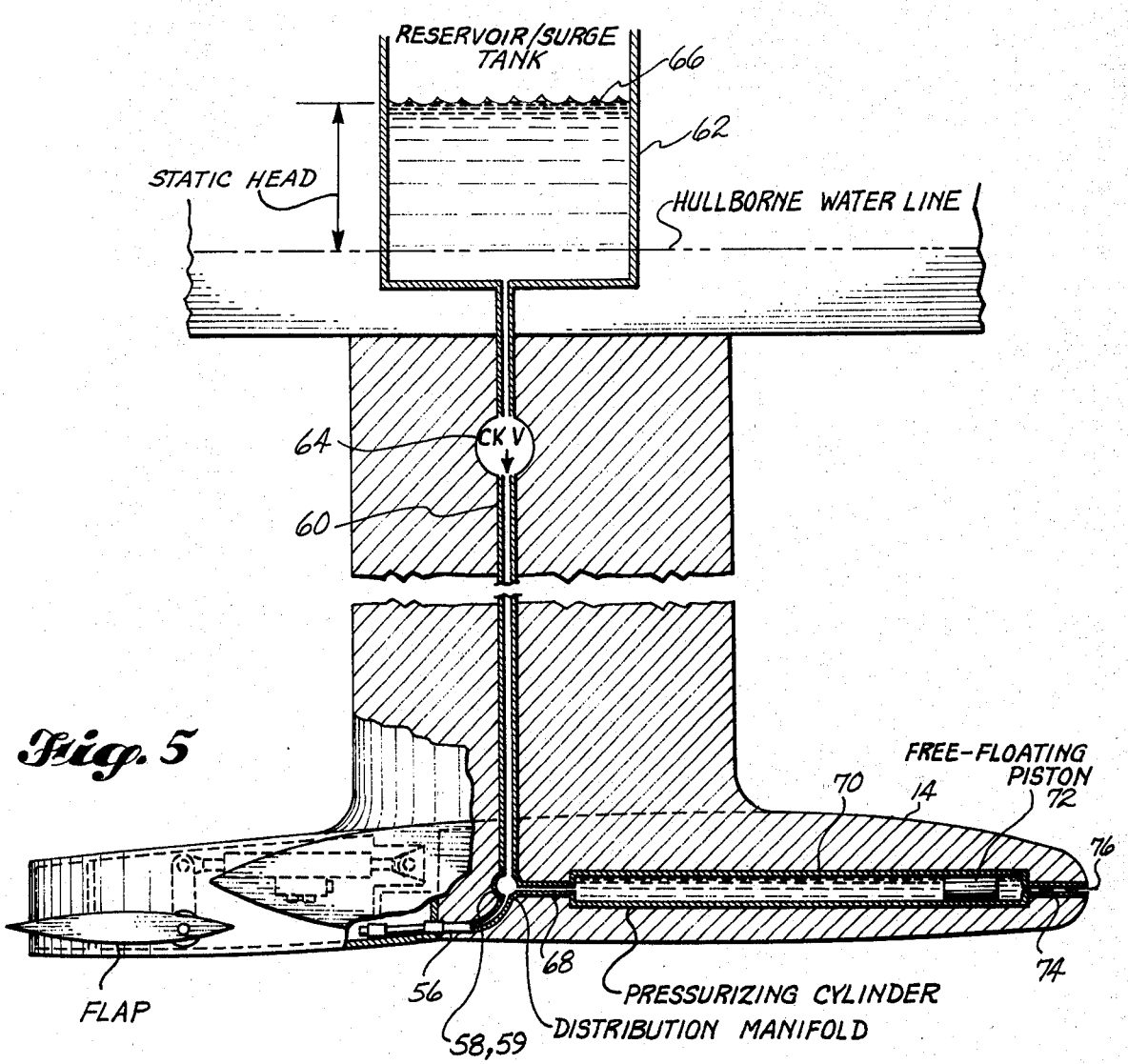
FIG. 5 is a sectional view through the stut-foil assembly of the hydrofoil craft showing the means for regulating internal pressure within the actuator housing in accordance with my invention.

Referring now to FIG. 5, fluid line 56 continues forward through the foil 16 to a tee 58 located in pod 14. One branch of the tee 58 is a vertical conduit 60 extending upwardly through the strut 12 to a surge tank 62 mounted to the hydrofoil craft at least partially above the hullborne water line. If several actuators 22 are needed to operate control flap 20 as shown in FIG. 1, a fluid line 56 would be required for each actuator 22. A distribution manifold 59 running spanwise in the foil 16 would be required to connect the fluid lines 56 with conduit 60. Vertical conduit 60 contains a check valve 64 so that flow is limited to the downward direction from the tank 62 toward tee 58. Disposed in the surge tank 62 is inert fluid 66 which at least partially fills the tank 62.

Another branch of tee 58 is horizontal conduit 68 extending forward through pod 14 toward an elongated chamber 70 which functions as a pressure distribution manifold. Elongated chamber 70 contains a free floating piston 72 disposed therein. The fore surface of the piston 72 is exposed to the external environment of the pod 14 through a tube 74 with an aperture 76.

The operation of my invention will be described assuming actuator 22 is of a conventional hydraulic servo type. The hydraulic servoactuator 22 is mounted within the actuator housing 18 which is attached to the aft foil spar 17 and submerged below water. Upon receiving a signal through line 24, from an automatic control system (not shown) on board the hydrofoil a hydraulic fluid (not shown) will be supplied to servoactuator 22 through supply line 26, or taken away from the servoactuator 22 through return line 28. The entry or removal of hydraulic fluid to servoactuator 22 moves a piston (not shown) within the servoactuator 22 and results in extension or retraction of rod 32. The movement of rod 32 is changed to a rotation of control flap 20 through rotation link 34. The leading edge control flap 20, therefore, is rotated up or down depending on the signal to the servoactuator 22. The only linkage required between rod 32 and control flap 20 is rotation link 34 and shafts 36 and 38.

To protect the servoactuator 22 from sea water, an inert fluid 66 is used. The fluid 66 can be a gas, such as air or any of the inert gases, or a liquid. The function of the inert fluid is to provide a benign, protective environment around the servoactuator 22 thereby inhibiting corrosion. My invention will be further described assuming the inert fluid 66 is a liquid. If a gas were utilized, however, an on-board air compressor, gas turbine bleed air, or other stored gas pressure vessel would be used as a source. The gas would be transmitted to housing 18 by way of lines 60, 58, 59 and 56 and the pressure regulated to slightly above the external total sea water pressure by conventional gas pressure regulators in lieu of surge tank 62.

In the preferred embodiement of my invention a liquid with a viscosity of greater than 0.25 centipoises such as an oil, is used as the inert fluid 66. The fluid 66 is allowed to fill actuator housing 18 through line 56, manifold 59, and vertical conduit 60. The servoactuator is surrounded by fluid 66.

Inert fluid 66 from surge tank 62 also fills horizontal conduit 68 and elongated chamber 70 up to the aft surface of free floating piston 72. If the hydrofoil craft is not moving, the static head of inert fluid 66 maintained in surge tank 62 by the height of fluid 66 above the hullborne waterline balances the external static pressure on the submerged actuator housing 18. This pressure regulating system is closed by the presence of the piston 72.

When the hydrofoil craft begins to move forward, the external pressure upon housing 18 includes a static component and a dynamic component due to the craft's movement through water. The external dynamic pressure varies according to the speed of the craft, and at normal hydrofoil cruising speeds is substantially greater than the static pressure. The external dynamic pressure can react 50 psi at 50 knots. As the external dynamic pressure increases, the pressure on the fore surface of piston 72 increases accordingly. Fore surface of piston 72 senses the maximum external dynamic pressure in the pod 14 at any point in time due to its exposure to the external environment through aperature 76 and its location in the forward part of pod 14. The external dynamic pressure acting on the fore surface of piston 72 pushes against and displaces piston 72 until the internal pressure of the inert fluid 66 acting on the aft surface of piston 72 balances the external dynamic pressure.

A check valve 64 is oriented in vertical conduit 60 to permit flow under static conditions toward the elongated chamber 70 and actuator housing 18. When the craft is underway, the check valve 64 will not permit flow upward to surge tank 62, and the bottom surface of check valve 64 will form a pressure boundary.

If the speed of the hydrofoil craft is decreased, the external dynamic pressure will decrease relative to the internal pressure in the housing 18. Free floating piston 72 will move forward in chamber 70 to compensate for speed reductions until the internal pressure in the housing 18 balances the external dynamic pressure. If needed, a relief valve (not shown) to prevent accidental over pressurization of the chamber 70 or housing 18, can be added to the chamber 70.

Compartment 40 is separated from the inner chamber of actuator housing 18 and has an access cover 44 which can be opened manually to permit access therein. If a separation of actuator housing 18 from spar 17 is desired for maintenance, inspection, or repair, access to mounting means 46 can be obtained through cover 44 and mounting means 46 can be disconnected without exposing the sevoactuator to sea water. Other structural connections can be removed in a like manner and the mating flanges 41 and 43 can be unbolted to free the housing from the control flap 20. To complete the separation of actuator housing 18 from the foil 16, entry to compartment 42 can be obtained through cover 47. The fittings 48, 50, 52 and 54 can be rapidly disconnected and the integrity of the actuator housing 18 need not be comprised. Separation of the housing 18 from the strut-foil assembly 10, therefore, can be carried out relatively easily without drydocking the hydrofoil craft. A repaired or new replacement housing can also be attached in a similar manner by reversing the above procedure.

What is claimed is:

1. A flap actuator control unit for a hydrofoil craft having strut-foil assembly and associated control flaps comprising, in combination:

a. a housing mounted to the strut-foil assembly of said hydrofoil craft;
b. a flap actuator mounted within said housing;
c. coupling means connecting said flap actuator to an associated power source in said hydrofoil craft for operating said flap actuator;
d. linkage means within said housing connecting said actuator with said hydrofoil control flap located external to said housing;
e. a tank mounted to said hydrofoil craft with at least a portion of said tank above the hullborne waterline of said hydrofoil craft;
f. an inert fluid filling said housing and at least partially filling said tank;
g. a first conduit communicating with said tank;
h. an elongated chamber disposed in said strut-foil assembly of said hydrofoil craft having a fore an aft end, said aft end communicating with said tank through said first conduit;
i. a check valve disposed in said first conduit to permit flow of said fluid from said tank to said elongated chamber only;
j. a second conduit communicating the aft end of said elongated chamber with said housing;
k. a piston having a fore and aft surface disposed in said elongated chamber; and
l. an aperture in the fore end of said elongated chamber open to the external environment, and permitting the fore surface of said piston to communicate with the external environment whereby the external dynamic pressure on said fore surface of said piston is counterbalanced by said inert fluid in said tank, said first conduit, said conduit and said housing.

2. The flap actuator control unit as recited in claim 1 wherein said inert fluid is a liquid with a viscosity greater than 0.25 centipoise.

3. The flap actuator control unit as recited in claim 1 wherein:

a. said housing includes a first and second compartment;
b. said frist compartment at least partially containing mounting means for mounting said housing to said strut-foil assembly of said hydrofoil craft;
c. said second compartment containing said coupling means connecting said flap actuator to an associated power source in said hydrofoil craft;
d. said first compartment and second compartment each having an access cover to permit entry therein to disconnect said mounting means and said coupling means whereby said housing and said strut-foil assembly can be separated without exposing said flap actuator to the external environment.

4. A flap actuator control unit for a hydrofoil craft having a strut-foil assembly and associated control flaps comprising, in combination:

a. a housing mounted to said strut-foil assembly of the hydrofoil craft;
b. a flap actuator mounted within said housing;
c. coupling means connecting said actuator to an associated power source in the hydrofoil craft for operating said actuator;
d. linkage means within said housing connecting said flap actuator with said hydrofoil control flap located external to said housing;
e. a tank mounted to said hydrofoil craft with at least a portion of said tank above the hullborne waterline of said hydrofoil craft;

f. an inert fluid filling said housing and disposed in said tank with at least a portion of said fluid above the hullborne waterline of said hydrofoil craft;

g. a first conduit communicating with said tank;

h. an elongated chamber disposed in said strut-foil assembly of said hydrofoil craft having a fore and aft end, said aft end communicating with said tank through said first conduit;

i. a check valve disposed in said first conduit to permit flow of said fluid from said tank to said elongated chamber only;

j. a second conduit communicating the aft end of said elongated chamber with said housing;

k. a piston having a fore and aft surface disposed in said elongated chamber; and l. an aperture in the fore end of said elongated chamber open to the external evnironment, and permitting the fore surface of said piston to communicate with the external environment whereby the external dynamic pressure on said fore surface of said piston is counterbalanced by said inert fluid in said tank, said first conduit, said second conduit and said housing.

5. A flap actuator control unit for a hydrofoil craft having a strut-foil assembly and associated control flaps comprising, in combination:

a. a housing mounted to said strut-foil assembly of the hydrofoil craft, said housing including a first and second compartment;

b. a flap actuator mounted within said housing;

c. coupling means connecting said actuator to an associated power source in the hydrofoil craft for operating said actuator;

linkage means within said housing connecting said flap actuator with said hydrofoil control flap located external to said housing;

e. said first compartment of said housing at least partially containing mounting means for mounting said housing to said strut-foil assembly of said hydrofoil craft;

f. said second compartment of said housing containing said coupling means connecting said flap actuator to an associated power source in said hydrofoil craft;

g. said first compartment and second compartment each having an access cover to permit entry therein to disconnect said mounting means and said coupling means whereby sid housing and said strut-foil assembly can be separated without exposing said flap actuator to the external environment;

h. an inert fluid filling said housing, and i. an internal pressure regulating means communicating with said housing whereby the internal pressure in said housing is regulated by increasing or decreasing the pressure on said fluid in said housing, said internal pressure regulating means responsive to the external dynamic pressure on said housing and being so constructed that the internal pressure in said housing remains substantially equal to the external dynamic pressure on said housing.

* * * * *